US005715692A

United States Patent [19]

Pappas

[11] Patent Number: 5,715,692

[45] Date of Patent: Feb. 10, 1998

[54] REFRIGERANT CHARGING MANIFOLD VALVE

[76] Inventor: Michael A. Pappas, 7 Mountain View Ct., East Stroudsburg, Pa. 18301

[21] Appl. No.: 654,124

[22] Filed: May 28, 1996

[51] Int. Cl.[6] ..... G01K 13/00

[52] U.S. Cl. ..... 62/129; 62/292; 137/883

[58] Field of Search ..... 62/77, 129, 85, 62/125, 149, 126, 292, 475; 137/883

[56] References Cited

U.S. PATENT DOCUMENTS 5,540,254 7/1996 McGowan et al. ..... 62/292

5,603,224 2/1997 Scaringe et al. ..... 62/292

*Primary Examiner*—John M. Sollecito

[57] ABSTRACT

A refrigerant charging system comprising a hollow manifold having a first end and a second end and a central region therebetween; a suction port adjacent to the first end with a first line couplable to the suction side of a compressor of an air conditioner; a suction valve adjacent to the suction port and positionable between a closed orientation and an open orientation; a low pressure gage adjacent to the suction port; a discharge port adjacent to the second end with a second line couplable to the compressor of an air conditioner; a discharge valve adjacent to the discharge port and positionable between a closed orientation and an open orientation; a high pressure gage adjacent to the discharge port; a refrigerant port with a third line for coupling the central region of the manifold and to a refurbishing tank; a vacuum port with a fourth line located between the refrigerant port and the first end for coupling the manifold and a vacuum pump.

3 Claims, 3 Drawing Sheets

REFRIGERANT CHARGING MANIFOLD VALVE

BACKGROUND OF THE INVENTION

1. Field of the Invention

The present invention relates to a refrigerant charging system and more particularly pertains to removing old refrigerant from an air conditioning system and recharging the air conditioning system with fresh refrigerant.

2. Description of the Prior Art

The use of refrigerant recovery units is known in the prior art. More specifically, refrigerant recovery units heretofore devised and utilized for the purpose of charging air conditioner units are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,339,642 to Laukhuf discloses a refrigerant recovery device including a flow control manifold.

U.S. Pat. No. 5,005,375 to Manz et al. discloses a refrigeration equipment service apparatus with a quick disconnect coupling for minimizing refrigerant loss during servicing of equipment.

U.S. Pat. No. Des. 344,527 to Drago et al. discloses the ornamental design for a refrigerant recovery unit.

U.S. Pat. No. 5,020,331 to Michny discloses a refrigerant reclamation system.

U.S. Pat. No. 5,396,774 to Hubbell, Jr. discloses a by-pass manifold valve for charging, repairing and/or testing refrigerant systems.

U.S. Pat. No. 5,167,126 to Cartwright discloses a refrigerant recovery and recycling assembly.

While these devices fulfill their respective, particular objective and requirements, the aforementioned patents do not describe a refrigerant charging system for removing old refrigerant from an air conditioning system and recharging the air conditioning system with fresh refrigerant.

In this respect, the refrigerant charging system according to the present invention substantially departs from the conventional concepts and designs of the prior art, and in doing so provides an apparatus primarily developed for the purpose of removing old refrigerant from an air conditioning system and recharging the air conditioning system with fresh refrigerant.

Therefore, it can be appreciated that there exists a continuing need for new and improved refrigerant charging system which can be used for removing old refrigerant from an air conditioning system and recharging the air conditioning system with fresh refrigerant. In this regard, the present invention substantially fulfills this need.

SUMMARY OF THE INVENTION

In the view of the foregoing disadvantages inherent in the known types of refrigerant recovery units now present in the prior art, the present invention provides an improved refrigerant charging system. As such, the general purpose of the present invention, which will be described subsequently in greater detail, is to provide a new and improved refrigerant charging system and method which has all the advantages of the prior art and none of the disadvantages.

To attain this, the present invention essentially comprises a refrigerant charging system for removing old refrigerant from an air conditioning system and recharging the air conditioning system with fresh refrigerant comprising, in combination a hollow tubular manifold having a first end and a second end and a central region therebetween; a suction port adjacent to the first end with a first line coupled to the suction side of a compressor of an air conditioner to be discharged and charged; a suction valve adjacent to the suction port and positionable between a closed orientation to preclude the passage of refrigerant between the manifold and the compressor of the air conditioning system and an open orientation to allow the passage of refrigerant between the manifold and the compressor of the air conditioning system; a low pressure gage adjacent to the suction port; a discharge port adjacent to the second end with a second line coupled to the compressor of an air conditioner to be discharged and charged; a discharge valve adjacent to the discharge port and positionable between a closed orientation to preclude the passage of refrigerant between the manifold and the compressor of the air conditioning system and an open orientation to allow the passage of refrigerant between the manifold and the compressor of the air conditioning system; a high pressure gage adjacent to the discharge port; a refrigerant port with a third line coupling the central region of the manifold to a refurbishing tank with a supply of a new refrigerant for the addition of new refrigerant to the manifold and the compressor of the air conditioner; a vacuum port with a fourth line located between the refrigerant port and the first end coupling the manifold and a vacuum pump; a vacuum pump valve adjacent to the vacuum port and positionable between a closed orientation to preclude the passage of vacuum to the manifold and the compressor of the air conditioning system and an open orientation to allow the passage of vacuum to the manifold and the compressor of the air conditioning system; a reclaim port with a fifth line located between the refrigerant port and the second end coupling the manifold with a refrigerant reclaim unit; a reclaim valve adjacent to the reclaim port and positionable between a closed orientation to preclude the passage of reclaimed refrigerant from the manifold and the compressor of the air conditioning system and an open orientation to allow the passage of reclaimed refrigerant from the manifold and the compressor of the air conditioning system; and three caps positionable over the refrigerant port, vacuum port and reclaim port respectively when the third line, fourth line and fifth line respectively are removed from the manifold.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refrigerant charging system which has all the advantages of the prior art refrigerant recovery units and none of the disadvantages.

It is another object of the present invention to provide a new and improved refrigerant charging system which may be easily and efficiently manufactured and marketed.

It is a further object of the present invention to provide a new and improved refrigerant charging system which is of durable and reliable construction.

An even further object of the present invention is to provide a new and improved refrigerant charging system which is susceptible of a low cost of manufacture with regard to both materials and labor, and which accordingly is then susceptible of low prices of sale to the consuming public, thereby making such a refrigerant charging system economically available to the buying public.

Still yet another object of the present invention is to provide a new and improved refrigerant charging system which provides in the apparatuses and methods of the prior art some of the advantages thereof, while simultaneously overcoming some of the disadvantages normally associated therewith.

Even still another object of the present invention is to provide a new and improved refrigerant charging system for removing old refrigerant from an air conditioning system and recharging the air conditioning system with fresh refrigerant.

Lastly, it is an object of the present invention to provide a new and improved refrigerant charging system These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
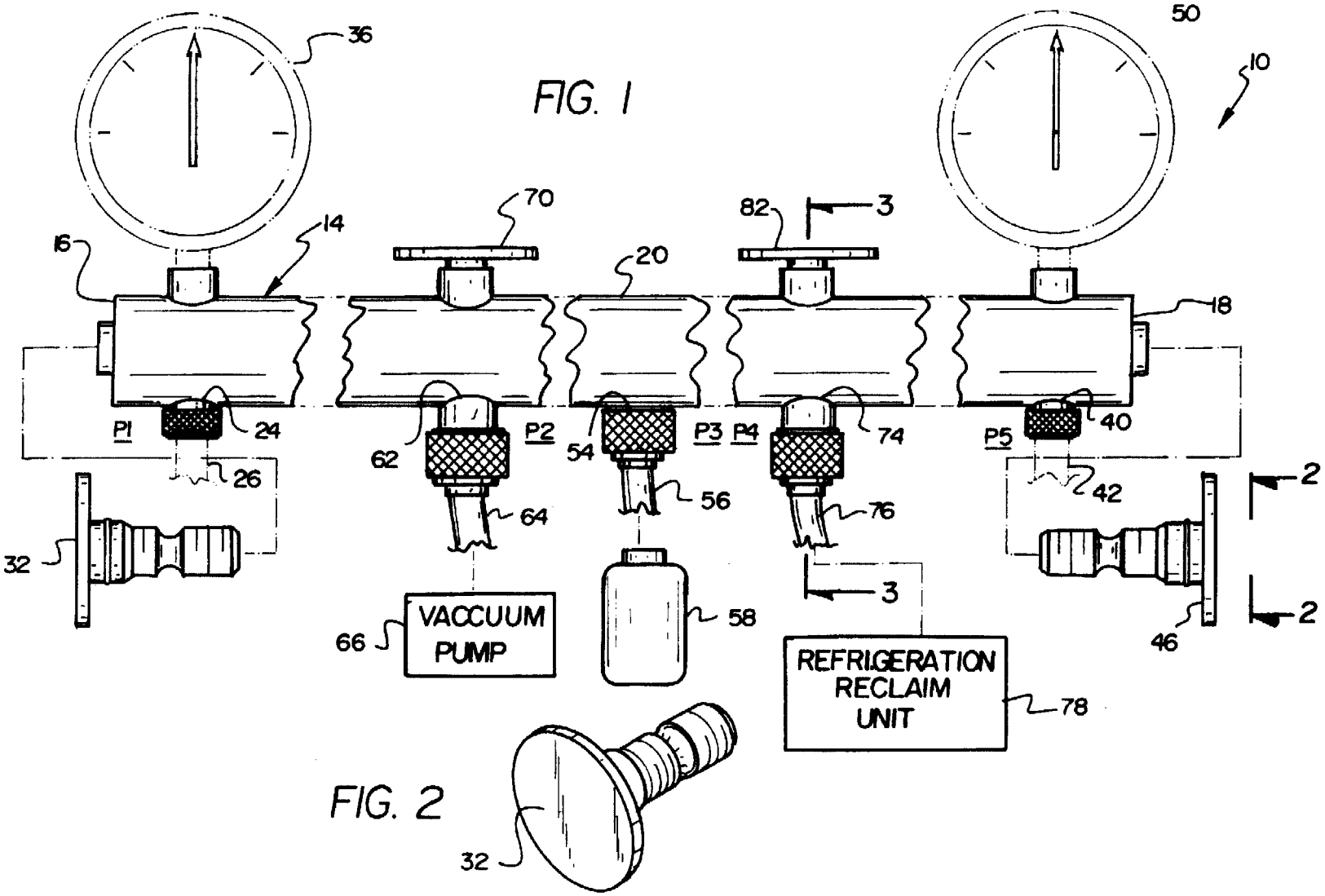
FIG. 1 is a perspective view of the preferred embodiment of the refrigerant charging system constructed in accordance with the principles of the present invention.
FIG. 2 is a perspective view of a valve of the present invention as taken along line 2—2 of FIG. 1.
Figure 3:
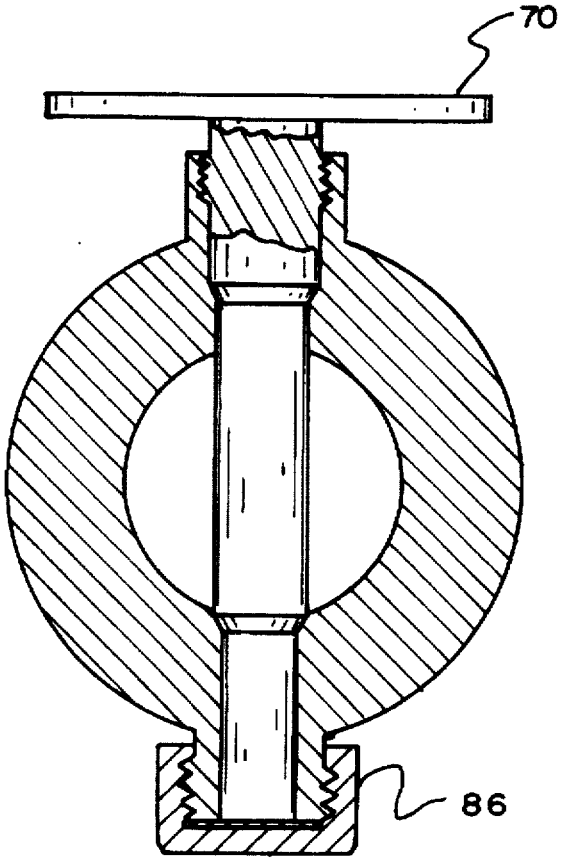
FIG. 3 is a cross-sectional view as taken along line 3—3 of FIG. 1.
Figure 4:
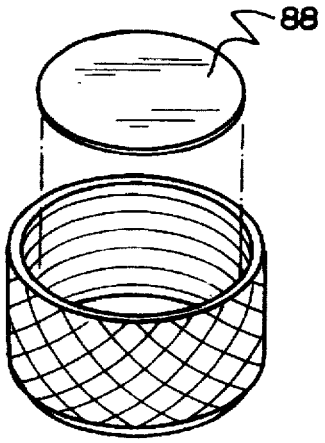
FIG. 4 is a elevated view of the protective cap of the present invention.
Figure 5:
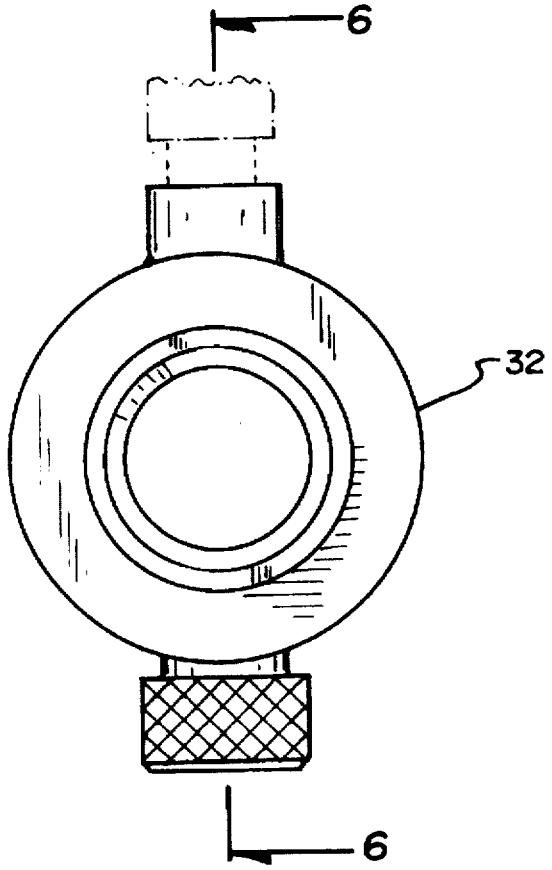
FIG. 5 is a front elevation view of the present invention.
Figure 6:
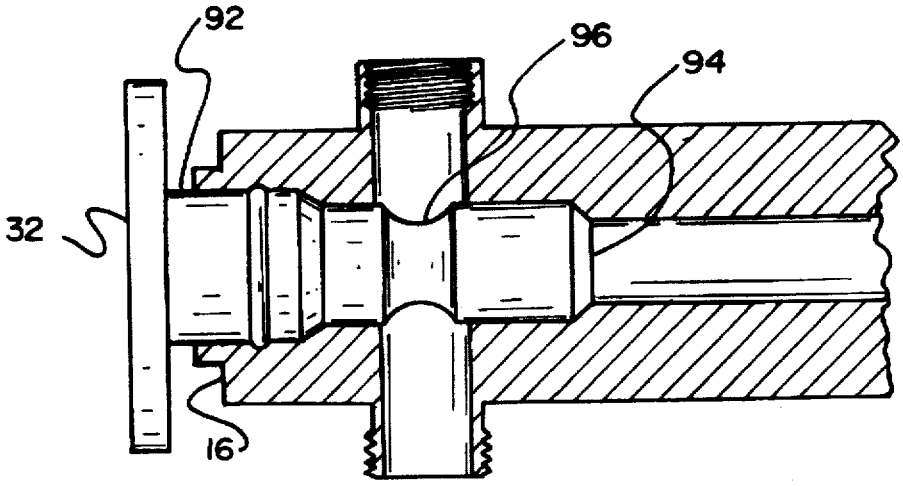
FIG. 6 is a cross-sectional view as taken along line 6—6 of FIG. 5.

With reference now to the drawings, and in particular, to FIGS. 1–6 thereof, the preferred embodiment of the new and improved refrigerant charging system embodying the principles and concepts of the present invention and generally designated by the reference number 10 will be described.

Specifically, it will be noted in the various Figures that the device relates to a refrigerant charging system 10 for removing old refrigerant from an air conditioning system, not shown, and recharging the air conditioning system with fresh refrigerant. The central component of the system is a hollow tubular manifold 14 having a first end 16 and second end 18 and a central region 20 therebetween;

Formed in the manifold is a suction port 24. Such suction port is located adjacent to the first end. In association therewith is a first line 26 coupled to the suction side, not shown, of a compressor of an air conditioner to be discharged and charged.

A suction valve 32 is operative located adjacent to the suction port and positionable to a closed orientation to preclude the passage of refrigerant between the manifold and the compressor of the air conditioning system. The suction valve is also positionable to an open orientation to allow the passage of refrigerant between the manifold and the compressor of the air conditioning system;

A low pressure gage 36 is operative located adjacent to the suction port.

Next provided is a discharge port 40. Such discharge port is located adjacent to the second end. The discharge port has a second line 42 coupled to the compressor of an air conditioner to be discharged and charged.

A discharge valve 46 is operatively positioned adjacent to the discharge port. It is positionable in a closed orientation to preclude the passage of refrigerant between the manifold and the compressor of the air conditioning system. It is also positionable in an open orientation to allow the passage of refrigerant between the manifold and the compressor of the air conditioning system.

A high pressure gage 50 is next provided. Such gage is operatively positioned adjacent to the discharge port.

A refrigerant port 54 is next provided. Such port includes a third line 56 coupling the central region of the manifold and a refurbishing tank 58 with a supply of a new refrigerant. Such line is for the addition of new refrigerant to the manifold and the compressor of the air conditioner.

A vacuum port 62 with a fourth line 64 is located between the refrigerant port and the first end. Such port and line is for coupling the manifold and a vacuum pump 66.

A vacuum pump valve 70 is formed in the manifold adjacent to the vacuum port and is positionable in a closed orientation to preclude the passage of vacuum to the manifold and the compressor of the air-conditioning system. Such valve is also positionable in an open orientation to allow the passage of vacuum to the manifold and the compressor of the air conditioning system.

A reclaim port 74 is also formed in the manifold with a fifth line 76 located between the refrigerant port and the second end. Such port is for coupling the manifold with a refrigerant reclaim unit 78.

A reclaim valve 82 is operatively positioned adjacent to the reclaim port and is positionable in a closed orientation to preclude the passage of reclaimed refrigerant from the manifold and the compressor of the air conditioning system. Such valve is also positionable in an open orientation to allow the passage of reclaimed refrigerant from the manifold and the compressor of the air conditioning system.

Lastly provided are three caps 86. Such caps are threadedly positionable over the refrigerant port, vacuum port and reclaim port respectively when the third line, fourth line and fifth line respectively are removed from the manifold. Each cap has an internal resilient pad 88 for forming a seal with the portion of the manifold with which it into contact.

The valves have an exterior portion 92 for being rotated by a user to open and close the valve and its associated port. Each valve also has an interior portion 94 for contacting an adjacent portion of the manifold to effect the closing of the valve and its associated port. Between the external and internal portions is an annular recessed portion 96 to allow the flow of fluid axially within the manifold and past the valve when closed. Lastly, the end valves at ports P1 and P5 include an O-ring to preclude the flow of fluid from the manifold regardless of the orientation of the valves.

The system of the present invention is preferably utilized as follows: (1) hook up the lines to ports P1, P2, P4 and P5 and close port P3; (2) open the valves at ports P1, P2, P4, and P5; (3) start the vacuum running in order to clean out the manifold of existing air, moisture and debris; (4) continue vacuuming until the low pressure gage reads about 30 inches of vacuum, normally about two minutes; (5) after vacuuming, close the four valves; (6) shut off the vacuum and disconnect the hose at port P; (7) Read both gages with the compressor off; (8) start the reclaiming process; (9) open the valve at port P1 to take out the old refrigerant evacuating the suction or low side of the compressor; (10) open the valve at port P4 to evacuate the refrigerant from the low pressure side of the compressor; (11) close the valve at port P1 and open the valve at port P5 to evacuate the discharge or high side of the compressor whereby all refrigerant is out of the compressor; (12) close the valves at ports P1 and P5; (13) disconnect the hose from port P3; (14) pull a vacuum on the manifold by closing the valve at port P, note that the line may be maintained hooked up to the refrigerant tank with its associated valve at port P3 closed whereby it is not necessary to pull another vacuum on the manifold; (15) maintain the valves closed at ports P1, P5 and P4 and the compressor is ready to charge with new or fresh refrigerant; (16) open valves at ports P1 and P5 and the refrigerant will slowly enter the manifold and compressor over several minutes; (17) close the valve at port 5 after several minutes; (18) continue to charge through the valve at port P1; and (19) disconnect the manifold totally after the compressor is fully charged by closing the suction on at the high side of the compressor valve at port P5 and reclaiming back to the reclaimer tank any refrigerant left in the hose.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A refrigerant charging system for removing old refrigerant from an air conditioning system and recharging the air conditioning system with fresh refrigerant comprising, in combination:

a hollow tubular manifold having a first end and a second end and a central region therebetween;

a suction port adjacent to the first end with a first line coupled to the suction side of a compressor of an air conditioner to be discharged and charged;

a suction valve adjacent to the suction port and positionable between a closed orientation to preclude the passage of refrigerant between the manifold and the compressor of the air conditioning system and an open orientation to allow the passage of refrigerant between the manifold and the compressor of the air conditioning system;

a low pressure gage adjacent to the suction port;

a discharge port adjacent to the second end with a second line coupled to the compressor of an air conditioner to be discharged and charged;

a discharge valve adjacent to the discharge port and positionable between a closed orientation to preclude the passage of refrigerant between the manifold and the compressor of the air conditioning system and an open orientation to allow the passage of refrigerant between the manifold and the compressor of the air conditioning system;

a high pressure gage adjacent to the discharge port;

a refrigerant port with a third line coupling the central region of the manifold to a refurbishing tank with a supply of a new refrigerant for the addition of new refrigerant to the manifold and the compressor of the air conditioner;

a vacuum port with a fourth line located between the refrigerant port and the first end coupling the manifold and a vacuum pump;

a vacuum pump valve adjacent to the vacuum port and positionable between a closed orientation to preclude the passage of vacuum to the manifold and the compressor of the air conditioning system and an open orientation to allow the passage of vacuum to the manifold and the compressor of the air conditioning system;

a reclaim port with a fifth line located between the refrigerant port and the second end coupling the manifold with a refrigerant reclaim unit;

a reclaim valve adjacent to the reclaim port and positionable between a closed orientation to preclude the passage of reclaimed refrigerant from the manifold and the compressor of the air conditioning system and an open orientation to allow the passage of reclaimed refrigerant from the manifold and the compressor of the air conditioning system; and three caps positionable over the refrigerant port, vacuum port and reclaim port respectively when the third line, fourth line and fifth line respectively are removed from the manifold.

2. A refrigerant charging system comprising:

a hollow manifold having a first end and a second end and a central region therebetween;

a suction port adjacent to the first end with a first line couplable to the suction side of a compressor of an air conditioner;

a suction valve adjacent to the suction port and positionable between a closed orientation and an open orientation;

a low pressure gage adjacent to the suction port;

a discharge port adjacent to the second end with a second line couplable to the compressor of an air conditioner;

a discharge valve adjacent to the discharge port and positionable between a closed orientation and an open orientation;

a high pressure gage adjacent to the discharge port;

a refrigerant port with a third line for coupling the central region of the manifold and to a refurbishing tank;

a vacuum port with a fourth line located between the refrigerant port and the first end for coupling the manifold and a vacuum pump;

a vacuum pump valve adjacent to the vacuum port and positionable between a closed orientation and an open orientation;

a reclaim port with a fifth line located between the refrigerant port and the second end for coupling the manifold with a refrigerant reclaim unit; and a reclaim valve adjacent to the reclaim port and positionable between a closed orientation and an open orientation.

3. The system as set forth in claim 2 and further including:

three caps positionable over the refrigerant port, vacuum port and reclaim port respectively when the third line, fourth line and fifth line respectively are removed from the manifold.

* * * * *